US008578838B2

(12) United States Patent
Davidson

(10) Patent No.: US 8,578,838 B2
(45) Date of Patent: Nov. 12, 2013

(54) LOCK VALVE WITH GROOVED PORTING IN BORE

(75) Inventor: Noam Davidson, Vancouver (CA)

(73) Assignee: Marine Canada Acquisition Inc., Richmond (CA)

( * ) Notice: Subject to any disclaimer, the term of this patent is extended or adjusted under 35 U.S.C. 154(b) by 1228 days.

(21) Appl. No.: 12/417,585

(22) Filed: Apr. 2, 2009

(65) Prior Publication Data

US 2009/0249776 A1 Oct. 8, 2009

Related U.S. Application Data

(60) Provisional application No. 61/042,188, filed on Apr. 3, 2008.

(51) Int. Cl.
*F15B 7/06* (2006.01)

(52) U.S. Cl.
USPC ..... 91/420

(58) Field of Classification Search
USPC ..... 91/420
See application file for complete search history.

(56) References Cited

U.S. PATENT DOCUMENTS

| | | | | |
|---|---|---|---|---|
| 3,756,280 | A | 9/1973 | Parquet | |
| 4,669,494 | A | 6/1987 | McBeth | |
| 6,579,072 | B2 | 6/2003 | Trousil et al. | |
| 7,254,945 | B1 * | 8/2007 | Sakai et al. | 91/420 |

* cited by examiner

*Primary Examiner* — F. Daniel Lopez
(74) *Attorney, Agent, or Firm* — Cameron IP

(57) ABSTRACT

A lock valve includes a lock valve body having a bore with a valve spool reciprocatingly received therein. There is a check valve adjacent each end of the bore. Each of the check valves has a check valve member facing the bore and resiliently biased towards a valve seat at each end of the bore. A pressure relief port communicates with the bore near the center thereof and between lands of the valve spool. A pair of spaced-apart grooves are disposed within the spool valve bore. Each groove permits fluid communication past a land of the valve spool when the valve spool is displaced towards one end of the bore by fluid pressure applied to other end of the bore so as to unseat the check valve member adjacent to the one end to the bore and allow pressurized fluid to pass from the one end of the bore, through the groove, and into the relief port.

4 Claims, 10 Drawing Sheets

LOCK VALVE WITH GROOVED PORTING IN BORE

CROSS REFERENCE TO RELATED APPLICATION

This application claims the benefit of provisional application 61/042,188 filed in the United States Patent and Trademark Office on Apr. 3, 2008, the disclosure of which is incorporated herein by reference and priority to which is claimed.

BACKGROUND OF THE INVENTION

1. Field of the Invention

The present invention relates generally to spool valves and, in particular, to lock valves for marine steering systems.

2. Description of the Related Art

Lock valves are conventional components of marine steering systems. Such lock valves include a valve spool which is reciprocatingly received in a valve spool bore in a body of the valve. The lock valve has ports connecting it to a helm which steers a marine vessel as well as ports connecting it to a steering actuator, typically a hydraulic cylinder.

A problem may occur when the fluid flow pumped from the helm differs from the fluid flow returning to the helm. This may occur in certain conditions including in situations where the steering cylinder is unbalanced. One solution to this problem has been to provide a partial return to tank to allow pressure relief in such a situation.

One earlier related patent is U.S. Pat. No. 4,669,494 issued on Jun. 2, 1987 to McBeth which discloses a hydraulic lock valve for marine steering with partial return to tank.

Another related patent is U.S. Pat. No. 6,579,072 issued on Jun. 17, 2003 to Trousil et al. which removes the need for a separate return port for the tank passageway and makes the valve easier and less expensive to manufacture.

SUMMARY OF THE INVENTION

It is an object of the present invention to provide an improved hydraulic steering system and, in particular, to provide an improved lock valve for a hydraulic steering system.

There is accordingly provided an improved lock valve for a hydraulic steering system. The valve includes a lock valve body having a spool valve bore therein. The bore has opposite first and second ends and a center. A check valve is disposed within a check valve chamber adjacent each end of the bore. Each of the check valves has a check valve member facing the bore and is resiliently biased towards a valve seat near said each end of the bore. A valve spool is reciprocatingly received within the bore. The valve spool has first and second lands with an annular space therebetween. The spool engages one of the check valve members when the spool is displaced towards said one check valve member.

There is a pair of helm ports, a first said helm port communicating with the bore near the first end thereof and a second said helm port communicating with the bore near the second end thereof. There also is a pair of steering actuator ports, each said steering actuator port communicating with one of the check valve chambers. A pressure relief port communicates with the bore near the center thereof and between the lands of the valve spool.

There is a pair of spaced-apart grooves in the lock valve body within the spool valve bore. A first said groove is near the first said end of the bore. The first said groove is positioned and sized to permit fluid communication past the first said land of the spool valve when said valve spool is displaced towards the first end of the bore by fluid pressure applied to the second end of the bore so as to unseat the check valve member adjacent to the first end to the bore and allow pressurized fluid to pass from the first end of the bore, through the first groove between the valve body and the first land of the valve spool and into the relief port. A second said groove is near the second said end of the bore. The second said groove is positioned and sized to permit fluid communication past the second land of the spool valve when said valve spool is displaced towards the second end of the bore by fluid pressure applied to the first end of the bore so as to unseat the check valve member adjacent to the second end of the bore and allow pressurized fluid to pass from the second end of the bore, through the second groove between the valve body and the second land of the valve spool and into the relief port.

There is also provided a method of forming pressure relief passageways in a lock valve. The method includes providing a tool having a rotary cutter. The cutter is placed within the spool valve bore of the valve parallel to a longitudinal axis thereof. The cutter is rotated and moved against the wall of the lock valve bore, thereby forming an elongated, trough-shaped groove in the wall of the bore. The groove closest to the cutter may be formed first. The cutter is then plunged deeper into the bore to machine the other groove from the same side of the lock valve body.

The lock valve disclosed herein provides significant advantages over earlier lock valves used in marine steering systems. Proper functioning of the partial return to tank requires accurate spacing of the related ports. This can be done by drilling the ports accurately into the spool valve bore as disclosed in U.S. Pat. No. 4,669,494 to McBeth. However the method of forming the trough-shaped ports is easier to employ with the required degree of accuracy. Accordingly the manufacturing process is more expedient and less expensive.

Furthermore, an immediate flow of fluid is desirable as soon as the spool valve is moved to a specified position within the bore. In the U.S. Pat. No. 6,579,072 to Trousil et al. this is accomplished when the land of the spool clears a relatively sharp edge in the bore. However in some situations at least it is desirable to provide a throttling effect with respect to the flow of fluid back to tank. This is particularly true in hydraulic systems with two or more helms where freewheeling may occur if the return to tank flow is not controlled. The use of trough-shaped grooves between the lands of the spool and the spool valve body, as found in the present invention, provides this desirable throttling effect with respect to the return to tank.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
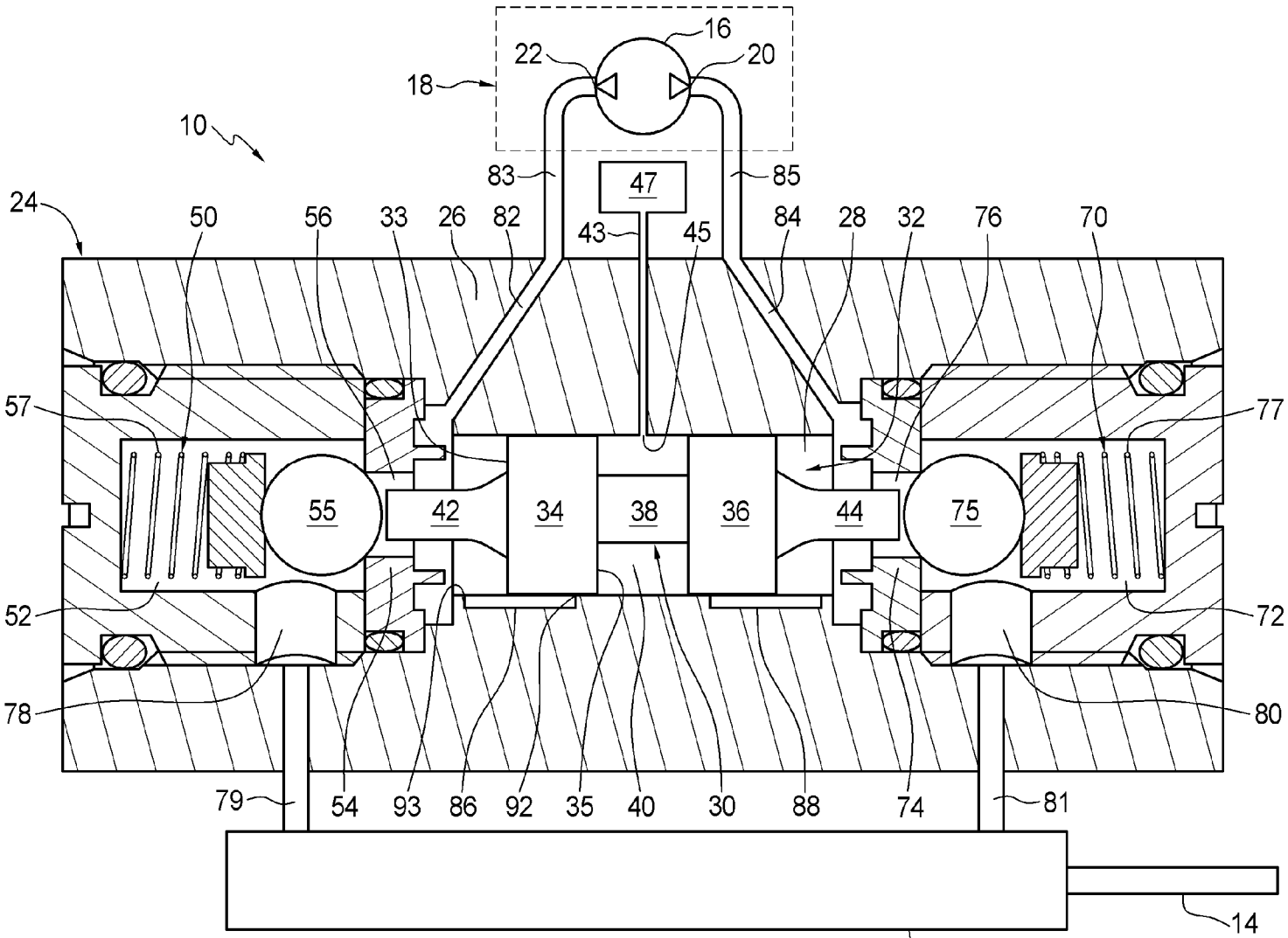
FIG. 1 is a partly diagrammatic and partly sectional view of a hydraulic steering system, showing a lock valve thereof in fragment and partially in section with a valve spool thereof in a central position

Referring to the drawings and first to FIG. 1, this shows an improved hydraulic steering system 10. The steering system 10 is typically used for marine steering applications, but may be used for other steering applications or other control applications. The steering system 10 includes a hydraulic steering cylinder 12 which is conventional and accordingly only described briefly herein. The cylinder 12 has a rod 14 which, in this example, extends from one end of the cylinder 12 and is connected to a rudder or some other steerable member such as an inboard/outboard drive or an outboard motor (not shown). The cylinder 12 is an unbalanced cylinder although in other embodiments a balanced cylinder may be used.

The steering system 10 includes a helm pump 16 that forms part of a helm 18 which is used to steer a marine vessel. In this example, the helm pump 16 is in the form of manually operable rotary pump. However, in alternative embodiments, motor driven pumps or helms may be used. The helm pump 16 has first and second helm pump ports 20 and 22 which serve to discharge or receive fluid depending upon the direction of rotation of the helm 18. The helm pump 16 and helm 18 are conventional and accordingly are not described further herein.

The steering system 10 also includes a lock valve 24. The lock valve 24 includes a lock valve body 26 having a main bore 28 with a valve spool 30 reciprocatingly received therein and thus forming a spool valve 32. The main bore 28 accordingly functions as a spool valve bore having first and second ends and a center. The valve spool 30 has first and second lands 34 and 36 separated by a narrower stem 38. An annular space 40 is defined in the area between the stem 38 and the valve body 26. There are projections 42 and 44 extending outwardly from opposite ends of the valve spool 30. In this example, the projections are generally in the shape of truncated cones though this is not critical. Other embodiments may not have such projections.

The lock valve 24 also includes a pair of check valves 50 and 70 located within check valve chambers 52 and 72 respectively. The check valve chambers 52 and 72 are located at opposite ends of the main bore 28 and are respectively separated from the main bore 28 by walls 54 and 74 apart from passageways 56 and 76. The passageways 56 and 76 extend through the walls 54 and 74 from the main bore 28 to corresponding check valve chambers 52 and 72. Each of the check valves 50 and 70 respectively includes a check valve member 55 and 75 and a resilient member 57 and 77. As described for one the check valves 50, the check valve member 55 is a ball which is normally biased against a valve seat at the wall 54 by the resilient member 57 which, in this example, is a coil spring. Accordingly, the check valves 50 and 70 normally block the passageways 56 and 76. The passageways 56 and 76 may also be described as steering actuator ports of the lock valve. It will be understood that other configurations of check valves may be used in other embodiments.

The lock valve 24 also has pair of cylinder ports 78 and 80 which are hydraulically connected to the cylinder 12 via hydraulic conduits 79 and 81 respectively. The hydraulic conduits 79 and 81 are connected to opposite ends of the cylinder 12 on opposite sides of a piston (not shown). The ports 78 and 80 communicate inwardly, with respect to the lock valve 24, with check valve chambers 52 and 72 respectively. The lock valve 24 also has a pair of helm ports 82 and 84 which are hydraulically connected to the helm pump 16 by hydraulic conduits 83 and 85 respectively. In this example the helm ports 82 and 84 are angled and communicate inwardly, with respect to the lock valve 24, with main bore 28.

In normal operation, when the helm 18 is steered, pressurized fluid is discharged from one of the helm pump ports 20 or 22. In the example shown in FIGS. 1, 1A, and 1B pressurized fluid is being discharged from the first helm pump port 20. Pressurized fluid discharged from the first helm pump port 20 enters the lock valve 24 via conduit 85 and port 84 and accordingly enters the main bore 28. As shown best in FIG. 1A, the fluid acts on the valve member 75 of check valve 70 so that the fluid flows through opening 76 and into a rod side of the cylinder 12 through port 80 and hydraulic conduit 81.

Figure 1A:
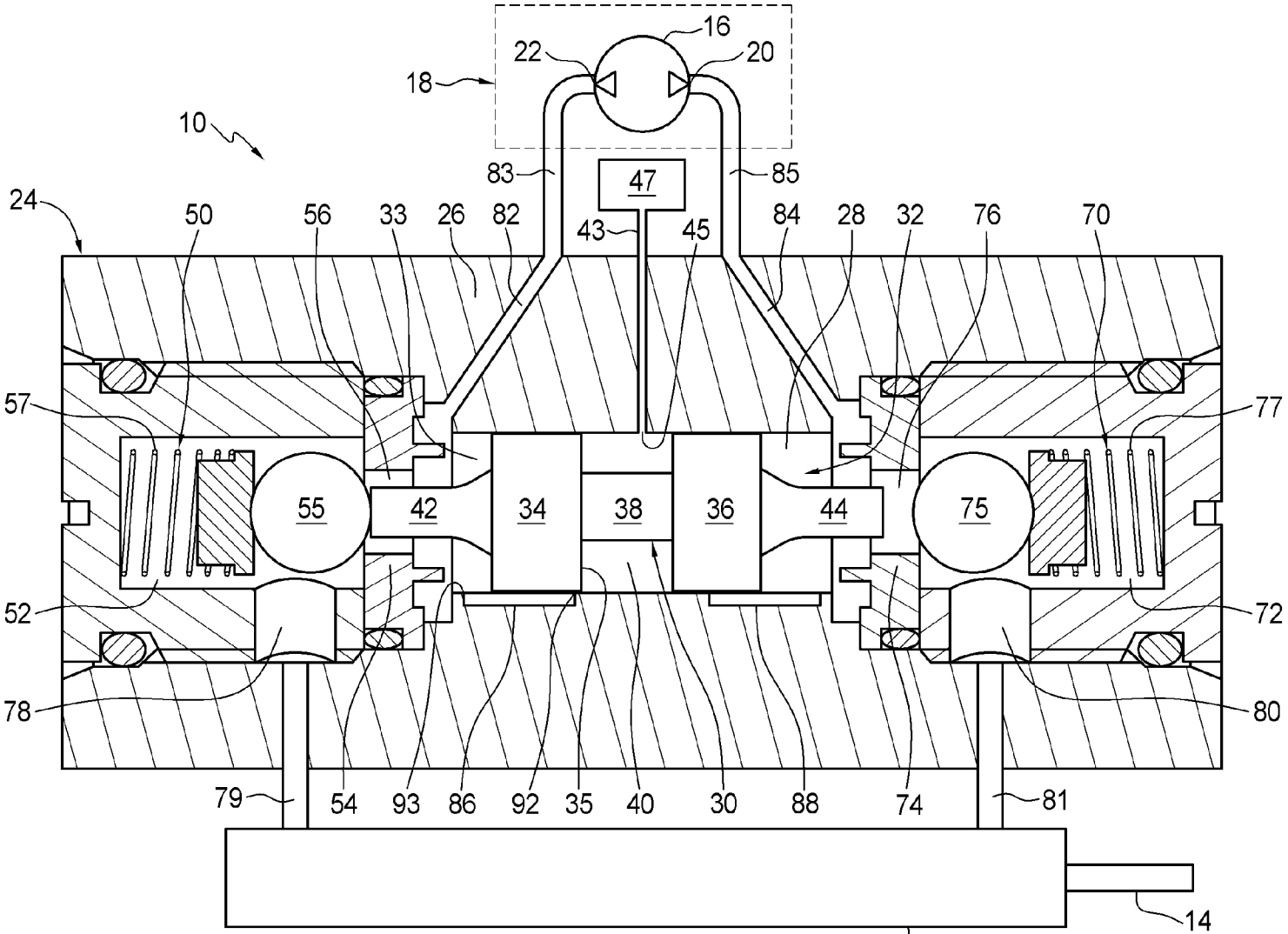
FIG. 1A is another partly diagrammatic and partly sectional view of the hydraulic steering system, showing the lock valve thereof in fragment and partially in section with the valve spool thereof shifted to the left.

The pressurized fluid also shifts the valve spool 30 to the left from the position shown in FIG. 1 to the position shown in FIG. 1A. As shown in FIG. 1A, this causes projection 42 to contact the check valve member 55 of check valve 50 and moves the check valve member 55 away from the valve seat at the wall 54, against the pressure of the resilient member 57, to allow communication between the main bore 28 and the check valve chamber 52 through the passageway 56. In embodiments without the projections, either the lands or ends of the spool may engage the check valve member. Thus moving the check valve member 55 permits a return flow of fluid from the cylinder 12 to pass through hydraulic conduit 79, port 78, check valve chamber 52, passageway 56, port 82, and conduit 83 and to the helm pump 16 through port 22.

As thus far described, the steering system 10 is generally conventional and it will be understood that the valve spool 30 is shifted to the right from the position shown in FIG. 1 if the helm is steered in the opposite direction and the fluid flow is substantially the opposite as described above.

Figure 2:
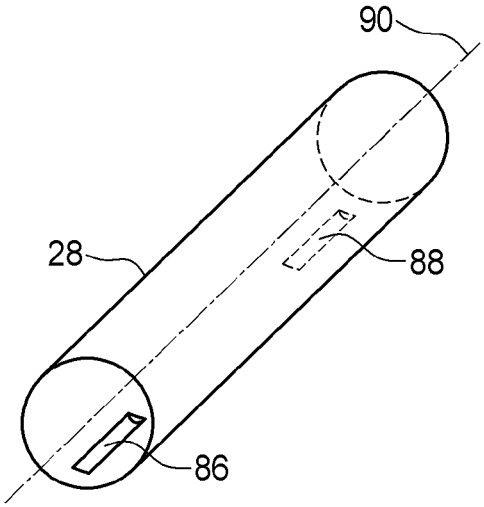
FIG. 2 is a ghost, isometric view of a main bore of the lock valve showing two trough-like grooves therein.
Figure 3:
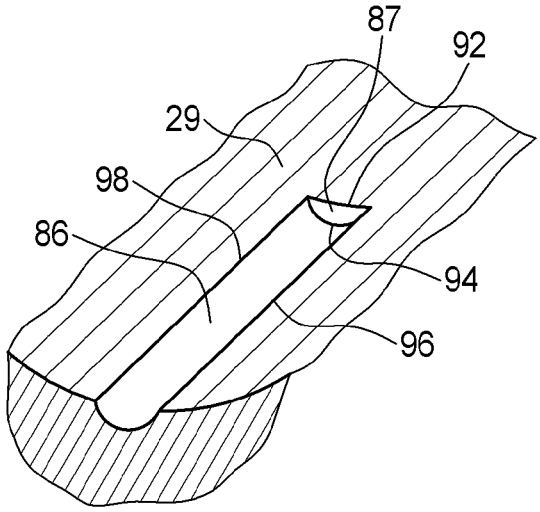
FIG. 3 is an enlarged, fragmentary, isometric view of one end of the bore showing one of the trough-like grooves.

However, the steering system 10 further includes a pair of spaced-apart first and second trough-like grooves 86 and 88 disposed within the main bore 28 between the lock valve body 24 and the valve spool 30, i.e. the grooves 86 and 88 are formed within the main bore 28 of the lock valve body 24. As best shown in FIG. 2, the grooves 86 and 88 are spaced-apart in a direction parallel to a longitudinal, central axis 90 of the main bore 28. It will be understood that the axis 90 is also a longitudinal, central axis of the valve spool 30 shown in FIG. 1. In this particular example, and as best shown in FIG. 3 for the first groove 86, each groove is in the shape of a cylindrical segment having a crescent-shaped cross section as shown at a first end 87 of the groove 86. The end 87 of the groove 86 has an outer edge 92 which is a circular segment defined by the curvature of a circular wall 29 of the main bore 28. An inner edge 94 of the end 87 of the groove 86 is also a circular segment defined by the curvature of the groove 86. In this example, the inner edge 94 has a smaller radius compared to the circular wall 29 of the main bore 28. The groove 86 has side edges 96 and 98 which are straight and parallel to the longitudinal, central axis 90 which is shown in FIG. 2. In this example, the groove 86 has a constant cross-section similar in shape to the end 87 thereof. The end 87 of the groove 86 is also perpendicular to the sides 96 and 98 of the groove 86 in this example. It will be understood that the other one of the grooves 88 has a similar structure.

Figure 1B:
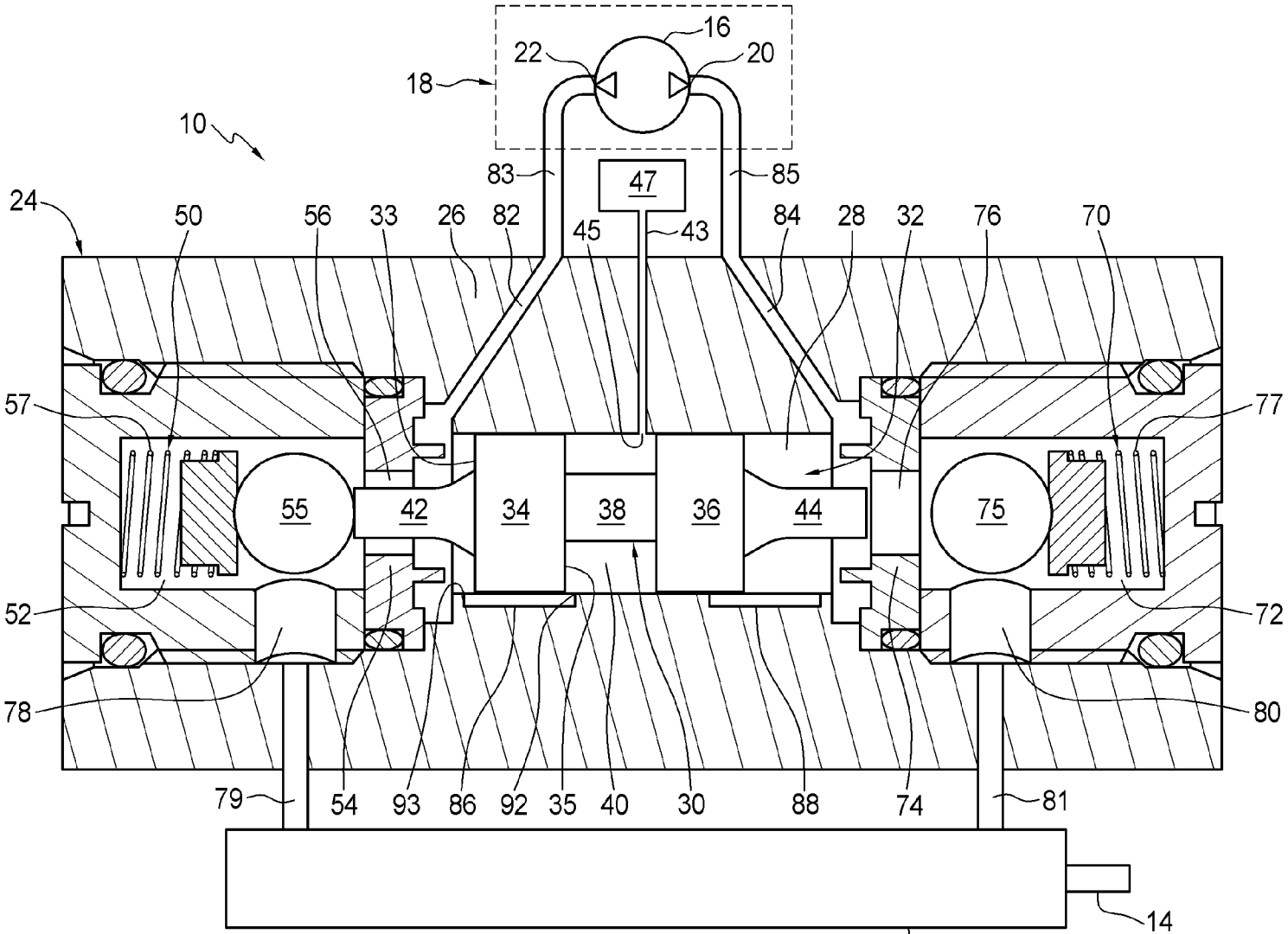
FIG. 1B is yet another partly diagrammatic and partly sectional view of the hydraulic steering system, showing the lock valve thereof in fragment and partially in section with the valve spool thereof shifted further to the left.

As viewed in FIG. 1, the first land 34 of the valve spool 30 has an inner circular edge 35 at a right end thereof facing the annular space 40. It will be understood that the terms "right" and "left" as used in the following description are for purposes of explanation only, with reference to FIGS. 1, 1A, and 1B, and do not have any significance in the orientation or function of the steering system 10 disclosed herein. In the position shown in FIG. 1 the first land 34 overlaps the edge 92 of the first end 87 of the first groove 86 so as to prevent communication between the annular space 40 and a portion of main bore 28 to the left of the land 34. As shown in FIG. 1A, if sufficient pressure is generated in the main bore 28 to the right of the valve spool 30, the valve spool 30 is shifted to the left until projection 42 presses against valve member 55 of the check valve 50 and unseats the valve as described above. However, if the pressure reaches a certain threshold level as shown in FIG. 1B, the valve spool 30 is displaced further to the left against the pressure of the spring 57 until the circular edge 35 of the land first 34 clears the edge 92 of the first groove 86 to the left. The edge 92 of the groove 86, in this example, is in the form of a shoulder at the end of the groove 86 which extends about the main bore 28 a distance equal to the width of the edge 92 and is parallel to the circular edge 35 of the land 34. The groove 86 extends to a second end 93 which is located to the left of the land 34, from the point of view of FIG. 1, so that circular edge 35 of the land 34 is to the right of the second edge 93 of the groove. Accordingly, when a the circular edge 35 of the land 34 clears the edge 92 of the groove 86 to the left, an opposite circular edge 33 on the right end of the land 34 is still to the right of the second end 93 of the groove 86. Accordingly, fluid is free to travel from the portion of main bore 28 to the left of land 34, through the first groove 86 and into the annular space 40. The linear increase in area of the fluid passageway occurs over a short transition distance, i.e. the slope of the linear increase in cross-sectional area is very steep.

There is a reservoir conduit 43 which extends from an opening 45 located on the main bore 28 to a hydraulic fluid reservoir or tank 47. The opening 45 may be described as a pressure relief port for the lock valve 24. Thus, when the pressure to the right of the valve spool 30, caused by fluid discharged from for the first helm pump port 20 of helm pump 16 exceeds a threshold value, fluid returning to the helm pump 16 through the second helm pump port 22, and entering the main bore through port 78 and opening 56, can either return to the helm 16 through port 82 and conduit 83 or pass through the first groove 86 and into the reservoir 47 through opening 45 and conduit 43. This allows any extra fluid volume returning to the helm pump 16 to return to the reservoir 47.

Figure 10:
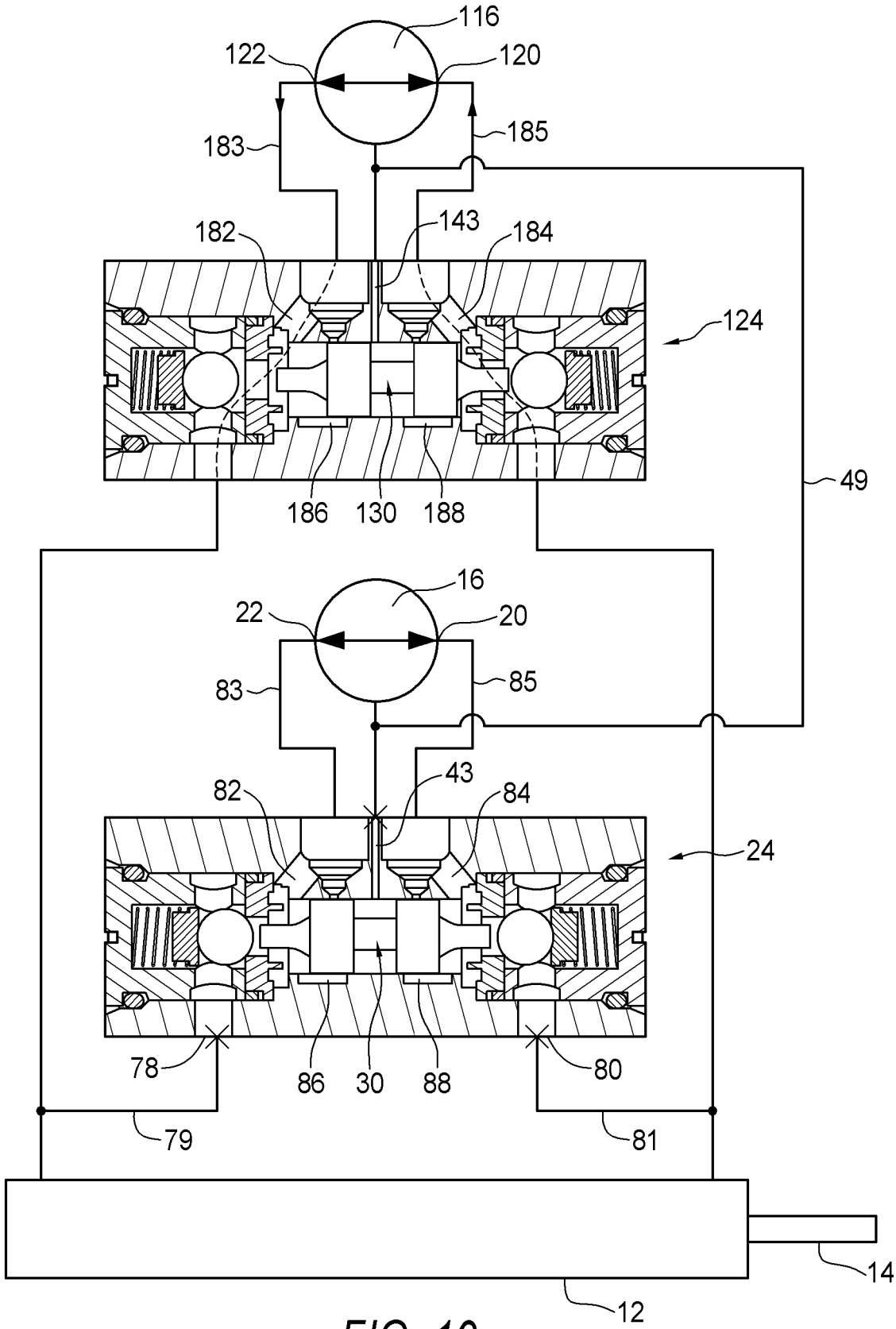
FIG. 10 is a schematic diagram of a variation thereof having two helms.

The trough-shape of the groove 86 offers significant advantages. When the land 34 crosses the edge 92 of the groove 86, there is a linear increase in cross-sectional area until the area is equal to the semicircular groove. This is particularly important for systems having two or more helms in parallel as shown in FIG. 10. Conventional lock valves may produce a free-wheeling condition when two or more helm pumps are connected in parallel. Restricting the return flow to the reservoir by this throttling action inhibits free-wheeling from occurring.

The operation is similar if helm pump 116 FIG. 10 is operated instead of helm pump 16. Lock valve 124 for helm pump 116 is similar to the lock valve 24 for helm pump 16 and like parts have like numbers in the "100" series. Also in FIG. 10 the helm ports are shown straight instead of angled. The reservoir conduit 143 for spool valve 124 is connected to the reservoir conduit 43 of spool valve 30 by a conduit 191 shown in FIG. 10.

It will be understood by a person skilled in the art that trough-shaped groove 88 provides similar pressure relief to the reservoir 47 when the valve spool 30 is shifted to the right due to pressurize fluid discharged from the second helm pump port 22 of the helm pump 16. Proper functioning of the lock valves requires accurate positioning of the ports controlling discharge to the reservoir. In the past this has been achieved using holes and grooves on spools or angled holes through the main bore to provide a means to return unbalanced flow. However the lock valve disclosed herein provides a much more expedient and inexpensive way of achieving the desired accuracy.

An alternative embodiment of the lock valve 24.1 is shown in FIGS. 6 to 9. The lock valve 24.1 shown in FIGS. 6 to 9 is generally similar to the lock valve 24 shown in FIG. 1, and like parts have been given the same reference numbers with the additional numerical designation ".1". However, in the embodiment shown in FIGS. 6 to 9 helm ports 82.1 and 84.1 extend perpendicularly from the spool valve bore 28.1 instead of at angles as in the embodiment of FIG. 1. In addition separate valve seats are used and the check valve members 55.1 and 75.1 subassemblies with a frusto-conical portion directed towards the valve spool 30.1.

Figure 4:
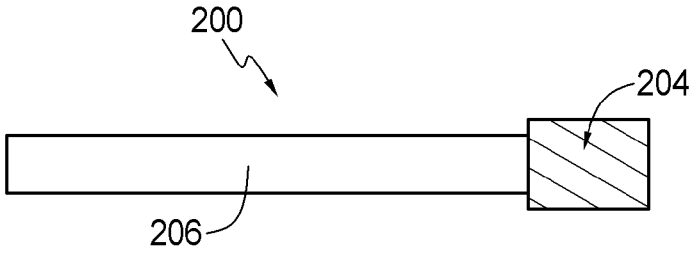
FIG. 4 is a side, sectional view of a rotary tool for forming trough-like grooves in the main bore of the lock valve.
Figure 5:
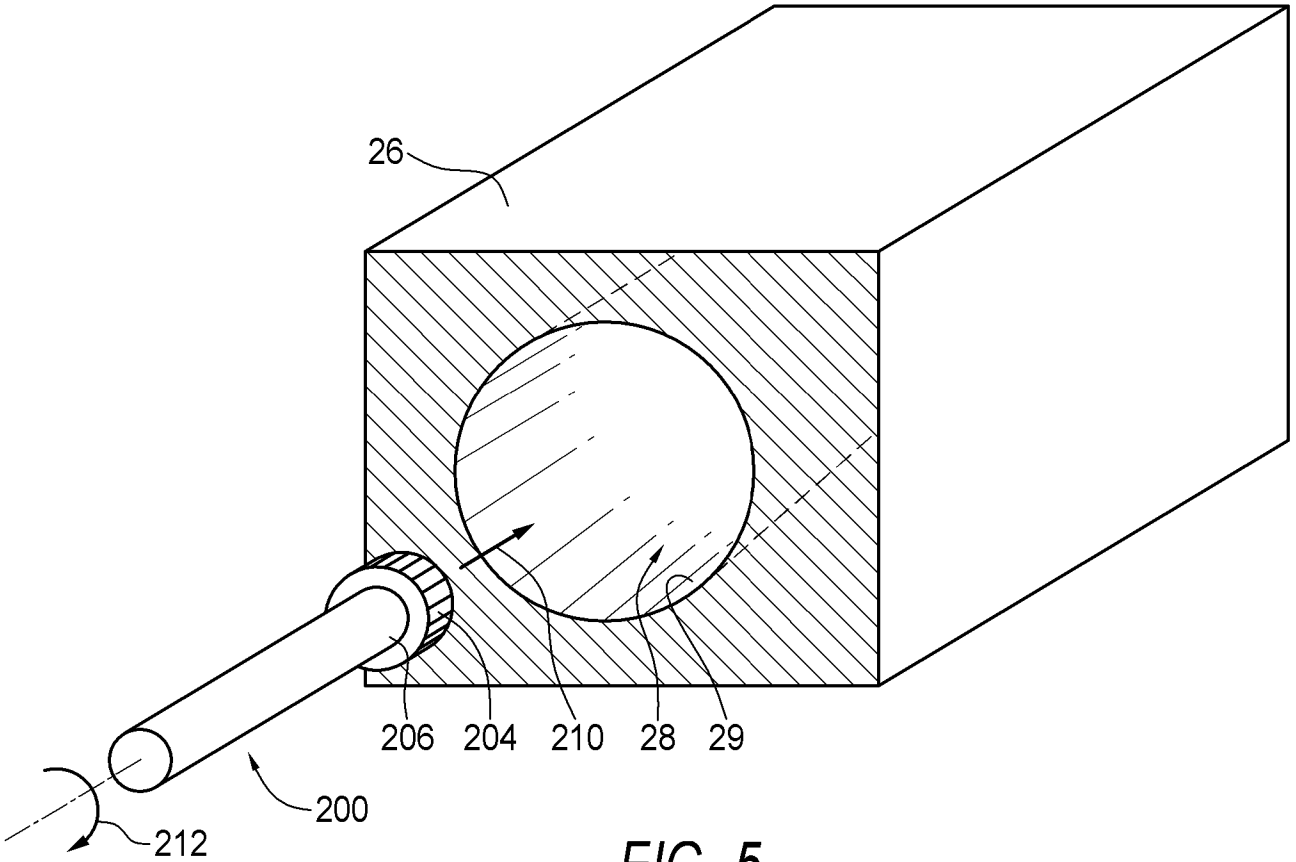
FIG. 5 is a simplified, isometric view of a fragment of the body of the lock valve thereof and the rotary tool.
Figure 6:
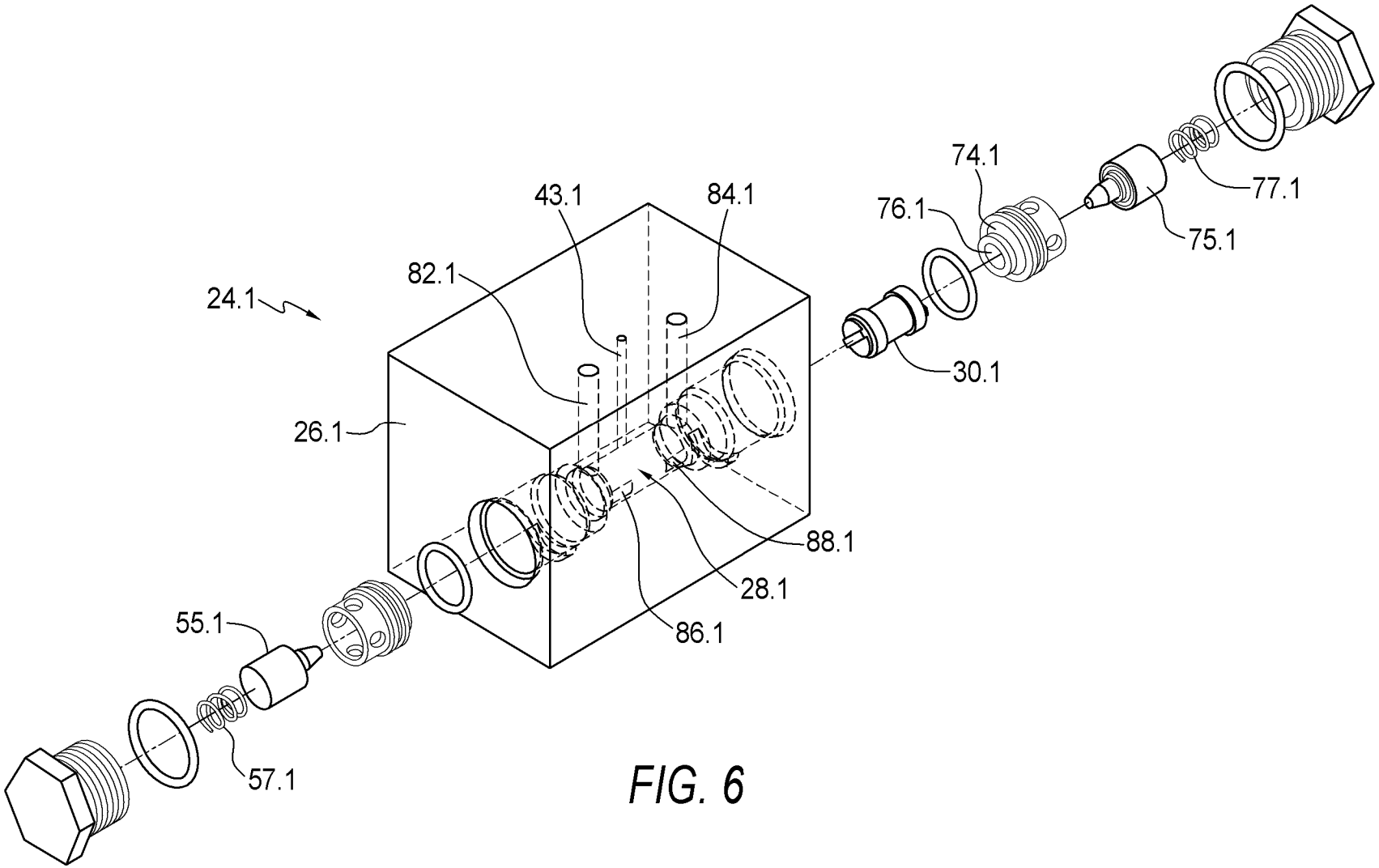
FIG. 6 is an exploded, isometric view of a lock valve according to another embodiment.
Figure 7:
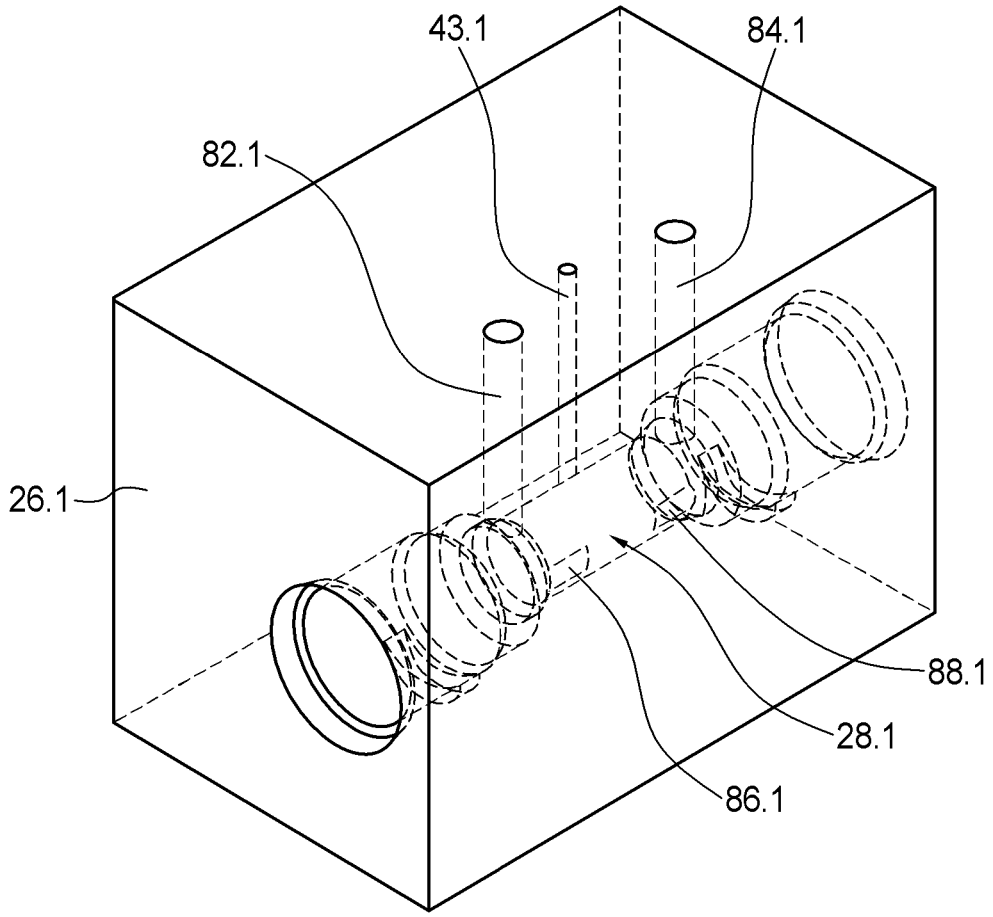
FIG. 7 is an isometric, ghost view of the valve body thereof.
Figure 8:
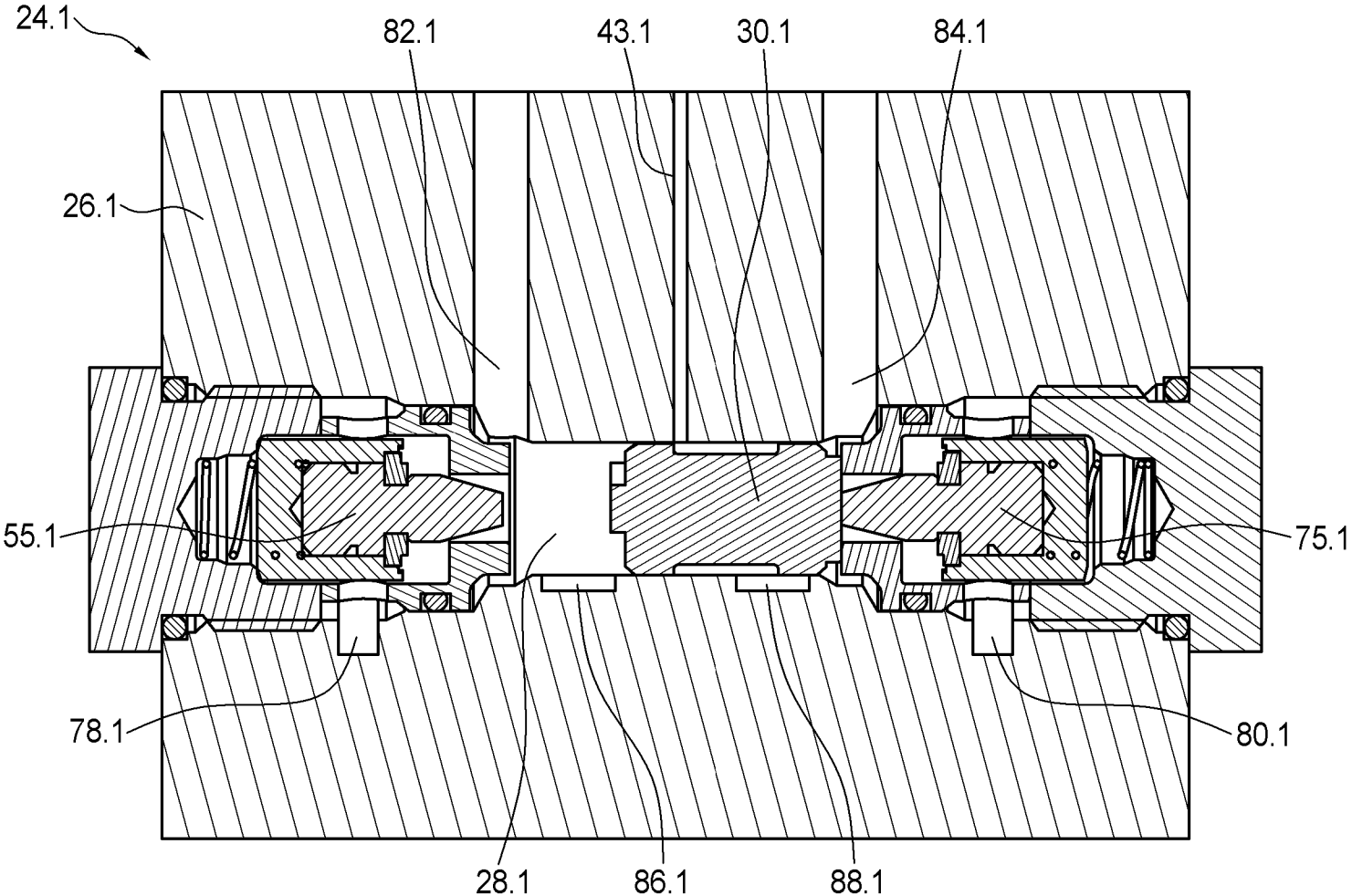
FIG. 8 is a sectional view thereof with the valve spool thereof shifted to the right.
Figure 9:
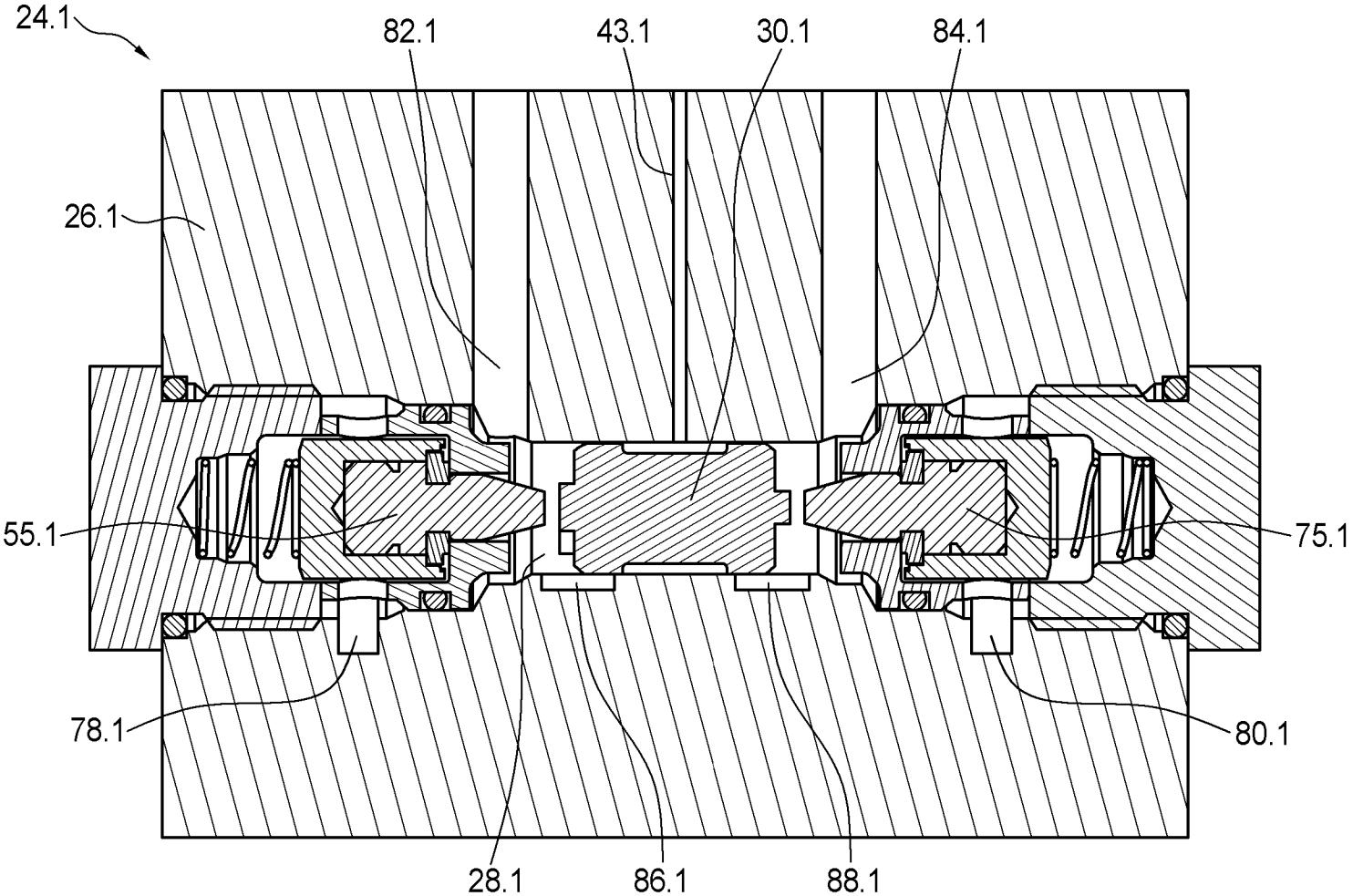
FIG. 9 is a sectional view thereof with the valve spool thereof in a central position.

With reference to FIGS. 4 and 5, these illustrate a rotary tool 200 for forming the trough-shape grooves accurately within the main bore 28 of the lock valve body 26. This tool 200 has a circular, rotary cutter or land 204 located on a shaft 206 which is held and rotated by a rotary power mechanism. The grooves are formed by inserting the tool 200 into the main bore 28 as indicated by arrow 210 in FIG. 5. The tool is rotated as indicated by arrow 212 and pressed against the wall 29 of the main bore 28 to form the grooves. This is easier to control and achieves more accurate result compared to drilling holes in the lock valve body 26 to intersect with the main bore 28. It should be understood however that the grooves could be produced in other ways besides the method described above. For example, the grooves could be broached or cast.

In this example the trough-like grooves are 0.008" deep between the centers of the edges 96 and 98 shown in FIG. 3, but the dimensions could be different in other embodiments.

While preferred embodiments of the present invention have been described, it is to be understood that the embodiments described herein are illustrative only and the scope of the invention is to be defined solely by the appended claims when accorded a full range of equivalence, many variations and modifications naturally occurring to those of skill in the art from a perusal hereof. As is readily apparent the system and method of the present invention is advantageous in several aspects.

What is claimed is:

1. A lock valve for a hydraulic steering system comprising:

a lock valve body having a spool valve bore therein, the bore having opposite first and second ends and a center, a check valve within a check valve chamber adjacent each end of the bore, each of the check valves having a check valve member adjacent the bore and resiliently biased towards a valve seat near said each end of the bore;

a valve spool reciprocatingly received within the bore, the valve spool having first and second lands with an annular space therebetween and the spool being for engaging one of the check valve members when the spool is displaced towards said one check valve member;

a pair of helm ports, a first said helm port communicating with the bore near the first end thereof and a second said helm port communicating with the bore near the second end thereof;

a pair of steering actuator ports, each said steering actuator port communicating with one of the check valve chambers;

a pressure relief port communicating with the bore near the center thereof and disposed between the lands of the valve spool; and a pair of spaced-apart grooves in the lock valve body within the spool valve bore, a first said groove being near the first said end of the bore and a second said groove being near the second said end of the bore, the first said groove being positioned and sized to permit fluid communication past the first said land of the spool valve when said valve spool is displaced towards the first end of the bore by fluid pressure applied to the second end of the bore so as to unseat the check valve member adjacent to the first end of the bore and allow pressurized fluid to pass from the first end of the bore through the first groove between the lock valve body and the first land of the valve spool and into the relief port, and the second said groove being positioned and sized to permit fluid communication past the second land of the spool valve when said valve spool is displaced towards the second end of the bore by fluid pressure applied to the first end of the bore so as to unseat the check valve member adjacent to the second end of the bore and allow pressurized fluid to pass from the second end of the bore through the second groove between the lock valve body and the second land of the valve spool and into the relief port;

wherein each of the lands has an inner end facing the annular space and each of the grooves has a first end and a second end, the first end of each of the grooves being closer to the center of the bore than the second ends thereof, and the first ends being formed by a shoulder extending about the bore to provide a substantial release of fluid towards the relief port as soon as said each of the lands moves past the first end of said each groove when moving towards the second end of said each groove, and wherein the bore has a longitudinal axis and said each of the grooves has opposite, parallel sides which extend parallel to the axis, the shoulder extending perpendicular to the sides about a curvature of the bore.

2. A lock valve for a hydraulic steering system comprising:

a lock valve body having a spool valve bore therein, the bore having opposite first and second ends and a center, a check valve within a check valve chamber adjacent each end of the bore, each of the check valves having a check valve member adjacent the bore and resiliently biased towards a valve seat near said each end of the bore;

a valve spool reciprocatingly received within the bore, the valve spool having first and second lands with an annular space therebetween and the spool being for engaging one of the check valve members when the spool is displaced towards said one check valve member;

a pair of helm ports, a first said helm port communicating with the bore near the first end thereof and a second said helm port communicating with the bore near the second end thereof;

a pair of steering actuator ports, each said steering actuator port communicating with one of the check valve chambers;

a pressure relief port communicating with the bore near the center thereof and disposed between the lands of the valve spool; and a pair of spaced-apart grooves in the lock valve body within the spool valve bore, each of the grooves being crescent-shaped in section, a first said groove being near the first said end of the bore and a second said groove being near the second said end of the bore, the first said groove being positioned and sized to permit fluid communication past the first said land of the spool valve when said valve spool is displaced towards the first end of the bore by fluid pressure applied to the second end of the bore so as to unseat the check valve member adjacent to the first end of the bore and allow pressurized fluid to pass from the first end of the bore through the first groove between the lock valve body and the first land of the valve spool and into the relief port, and the second said groove being positioned and sized to permit fluid communication past the second land of the spool valve when said valve spool is displaced towards the second end of the bore by fluid pressure applied to the first end of the bore so as to unseat the check valve member adjacent to the second end of the bore and allow pressurized fluid to pass from the second end of the bore through the second groove between the lock valve body and the second land of the valve spool and into the relief port.

3. A hydraulic steering system comprising:

a hydraulic steering actuator;

a hydraulic pump; and a lock valve body having a spool valve bore therein, the bore having opposite first and second ends and a center, a check valve within a check valve chamber adjacent each end of the bore, each of the check valves having a check valve member adjacent the bore and resiliently biased towards a valve seat near said each end of the bore; a valve spool reciprocatingly received within the bore, the valve spool having first and second lands with an annular space therebetween and the spool being for engaging one of the check valve members when the spool is displaced towards said one check valve member; a pair of helm ports, a first said helm port communicating with the bore near the first end thereof and a second said helm port communicating with the bore near the second end thereof; a pair of steering actuator ports, each said steering actuator port communicating with one of the check valve chambers; a pressure relief port communicating with the bore near the center thereof and disposed between the lands of the valve spool; a pair of spaced-apart grooves in the lock valve body within the spool valve bore, a first said groove being near the first said end of the bore and a second said groove being near the second said end of the bore, the first said groove being positioned and sized to permit fluid communication past the first said land of the spool valve. When said valve spool is displaced towards the first end of the bore by fluid pressure applied to the second end of the bore so as to unseat the check valve member adjacent to the first end of the bore and allow pressurized fluid to pass from the first end of the bore through the first groove between the lock valve body and the first land of the valve spool and into the relief port, and the second said groove being positioned and sized to permit fluid communication past the second land of the spool valve when said valve spool is displaced towards the second end of the bore by fluid pressure applied to the first end of the bore so as to unseat the check valve member adjacent to the second end of the bore and allow pressurized fluid to pass from the second end of the bore through the second groove between the lock valve body and the second land of the valve spool and into the relief port;

wherein each of the lands has an inner end facing the annular space and each of the grooves has a first end and a second end, the first end of each of the grooves being closer to the center of the bore than the second ends thereof, and the first ends being formed by a shoulder extending about the bore to provide a substantial release of fluid towards the relief port as soon as said each of the lands moves past the first end of said each groove when moving towards the second end of said each groove, and wherein the bore has a longitudinal axis and said each of the grooves has opposite, parallel sides which extend parallel to the axis, the shoulder extending perpendicular to the sides about a curvature of the bore.

4. A hydraulic steering system comprising:

a hydraulic steering actuator;

a hydraulic pump; and a lock valve body having a spool valve bore therein, the bore having opposite first and second ends and a center, a check valve within a check valve chamber adjacent each end of the bore, each of the check valves having a check valve member adjacent the bore and resiliently biased towards a valve seat near said each end of the bore; a valve spool reciprocatingly received within the bore, the valve spool having first and second lands with an annular space therebetween and the spool being for engaging one of the check valve members when the spool is displaced towards said one check valve member; a pair of helm ports, a first said helm port communicating with the bore near the first end thereof and a second said helm port communicating with the bore near the second end thereof; a pair of steering actuator ports, each said steering actuator port communicating with one of the check valve chambers; a pressure relief port communicating with the bore near the center thereof and disposed between the lands of the valve spool; and a pair of spaced-apart grooves in the lock valve body within the spool valve bore, each of the grooves being crescent-shaped in section, a first said groove being near the first said end of the bore and a second said groove being near the second said end of the bore, the first said groove being positioned and sized to permit fluid communication past the first said land of the spool valve when said valve spool is displaced towards the first end of the bore by fluid pressure applied to the second end of the bore so as to unseat the check valve member adjacent to the first end of the bore and allow pressurized fluid to pass from the first end of the bore through the first groove between the lock valve body and the first land of the valve spool and into the relief port, and the second said groove being positioned and sized to permit fluid communication past the second land of the spool valve when said valve spool is displaced towards the second end of the bore by fluid pressure applied to the first end of the bore so as to unseat the check valve member adjacent to the second end of the bore and allow pressurized fluid to pass from the second end of the bore through the second groove between the lock valve body and the second land of the valve spool and into the relief port.

* * * * *

UNITED STATES PATENT AND TRADEMARK OFFICE

CERTIFICATE OF CORRECTION

PATENT NO. : 8,578,838 B2
APPLICATION NO. : 12/417585
DATED : November 12, 2013
INVENTOR(S) : Noam Davidson It is certified that error appears in the above-identified patent and that said Letters Patent is hereby corrected as shown below:

In the claims:

Column 7, line 21, claim 1, please delete “spool valve” and insert --valve spool--.

Column 7, line 30, claim 1, please delete “spool valve” and insert --valve spool--.

Column 8, line 13, claim 2, please delete “spool valve” and insert --valve spool--.

Column 8, line 22, claim 2, please delete “spool valve” and insert --valve spool--.

Column 8, line 57, claim 3, please delete “spool valve. When said” and insert --valve spool when said--.

Column 8, line 66, claim 3, please delete “spool valve” and insert --valve spool--.

Column 10, line 15, claim 4, please delete “spool valve” and insert --valve spool--.

Column 10, line 24, claim 4, please delete “spool valve” and insert --valve spool--.

Signed and Sealed this
Twentieth Day of May, 2014

Michelle K. Lee

Michelle K. Lee
*Deputy Director of the United States Patent and Trademark Office*